US006138375A

United States Patent [19]

Humphries, II et al.

[11] Patent Number: 6,138,375

[45] Date of Patent: Oct. 31, 2000

[54] SUPPORT RING FOR PELLET DRYER SCREEN

[75] Inventors: Toney Reid Humphries, II, Covington; Todd Anthony Niccum, Roanoke; William Douglas Woodson, Eagle Rock, all of Va.

[73] Assignee: Gala Industries, Inc., Eagle Rock, Va.

[21] Appl. No.: 09/259,287

[22] Filed: Mar. 1, 1999

[51] Int. Cl.[7] ..... F26B 17/30

[52] U.S. Cl. ..... 34/59; 34/147; 34/166; 34/173; 34/183

[58] Field of Search ..... 34/58, 59, 142, 34/147, 166, 173, 182, 183; 416/210 R, 214 R, 216, 233, 131, 244 R; 464/170, 171, 172; 209/405, 406, 409

[56] References Cited

U.S. PATENT DOCUMENTS

| | | | |
|---|---|---|---|
| 264,824 | 9/1882 | Finch . | |
| 301,803 | 7/1884 | Cavanaugh . | |
| 319,572 | 6/1885 | Ferrier . | |
| 411,799 | 10/1889 | Filip . | |
| 533,457 | 2/1895 | Gunckel . | |
| 1,596,428 | 8/1926 | Greene . | |
| 2,536,054 | 1/1951 | Harrington | 31/48 |
| 3,458,045 | 7/1969 | Dudley | 210/95 |
| 3,794,166 | 2/1974 | Converse et al. | 209/301 |
| 4,017,387 | 4/1977 | Hatton et al. | 209/240 |
| 4,178,246 | 12/1979 | Klein | 210/82 |
| 4,476,019 | 10/1984 | Nowisch et al. | 210/232 |
| 4,565,015 | 1/1986 | Hundley, III | 34/182 |
| 4,570,359 | 2/1986 | Rudolph | 34/58 |
| 4,896,435 | 1/1990 | Spangler, Jr. | 34/58 |
| 5,187,880 | 2/1993 | Rudolph | 34/8 |
| 5,265,347 | 11/1993 | Woodson et al. | 34/58 |
| 5,476,143 | 12/1995 | Sparlin et al. | 166/233 |
| 5,611,150 | 3/1997 | Yore, Jr. | 34/58 |
| 5,638,606 | 6/1997 | Bryan et al. | 34/59 |
| 5,938,043 | 8/1999 | Costin et al. | 209/425 |

*Primary Examiner*—Stephen Gravini
*Attorney, Agent, or Firm*—Jacobson, Price, Holman & Stern, PLLC

[57] ABSTRACT

An improved support ring is disclosed for a polymer resin pellet dryer screen of the type which includes cylindrical screen sections interconnected by two semicircular bands forming a support ring or connecting band. The support ring is positioned in spaced relation to an exterior housing by brackets, and the screen encloses a driven bladed rotor for removing water from a slurry of water and pellets. The improved support ring comprises a two piece annular ring including a generally perpendicular, rigid flange attached to the exterior of a semicircular band pair. The flange rigidities the bands of the ring and supports the adjacent ends of the screen sections from the external housing to maintain the screen in cylindrical configuration and in concentric relation to the bladed rotor rotatably positioned within the screen.

19 Claims, 3 Drawing Sheets

SUPPORT RING FOR PELLET DRYER SCREEN

BACKGROUND OF THE INVENTION

1. Field of the Invention

The present invention generally relates to a support ring for the screen of a centrifugal polymer resin pellet dryer. More specifically, the present invention relates to a support ring which interconnects and supports vertical dryer screens of the type which include cylindrical screen sections. The support ring is positioned in spaced relation to an exterior housing of the dryer by brackets, and the screen encloses a driven bladed rotor for removing water from a slurry of water and pellets. The support ring supports adjacent ends of the screen sections from the external housing.

2. Description of the Prior Art

Centrifugal pellet dryers of both the vertical and horizontal type are well known and include an outer housing, a cylindrical screen oriented in the housing and a bladed rotor mounted in the screen for moving a slurry of water and pellets within the screen to enable discharge of water through the screen. A slurry inlet is provided along with an outlet for water and an outlet for the dried pellets. Centrifugal pellet dryers of the vertical type are disclosed in U.S. Pat. Nos. 3,458,045; 4,565,015; 4,896,435 and 5,265,347 commonly owned by the Assignee of this application. In the operation of such dryers, the screen, which is generally in a plurality of sections, usually two, must be maintained in a cylindrical configuration concentric with the periphery of the rotor to obtain efficient and long-lasting operation of the dryer. While the dryers disclosed in the above patents include support rings and other structure for supporting the screen sections, the ring or other structure is not satisfactory to prevent the adjacent ends of the cylindrical screen sections from becoming deformed and no longer in the prescribed cylindrical shape.

In addition to the above mentioned patents, some dryers or material separators are rotated about a horizontal or inclined axis. The following U.S. patents disclose various horizontally disposed or inclined drums having perforated surfaces to separate materials: U.S. Pat. Nos. 264,824; 301,803; 319,572; 533,457; 1,596,428 and 2,536,054. Also, additional vertical screen and conveyor structures are disclosed in U.S. Pat. Nos. 411,799; 4,017,387; 4,178,246; 4,570,359; 4,476,019; 5,187,880 and 5,611,150. These aforementioned patents disclose various screens or perforated members for receiving materials and which rotate or are provided with a rotor interiorly mounted with structures for supporting the stationary screen or perforated member.

Furthermore, manufacturers of commercial pellet dryers have used one and two piece support rings to connect and support screen sections in place within the dryer housing. In particular, the Assignee of this application has commercialized vertical pellet dryers with support rings for interconnecting adjacent ends of screen sections which comprise two semicircular bands forming a circular connecting band. The connecting band is then connected to the dryer housing at various spaced locations. This prior art assembly is described hereinafter in connection with FIG. 7 of the instant drawings.

However, none of the above prior art structures comprise a support ring which has the design or structure to withstand deformation of the connected screen section ends during use of the dryer, and which can be quickly installed or removed, or replaced, when necessary to remove or replace a screen section or gain access to the interior of the dryer.

SUMMARY OF THE INVENTION

The pellet dryer for which the present invention is particularly adapted is a centrifugal pellet dryer of the vertical type having at least two aligned screen sections making up the vertical screen, although the support ring of the present invention could be used to interconnect screen sections in a horizontal type pellet dryer or even to support the ends of a single screen in either a vertical type or horizontal type dryer. A conventional vertical type centrifugal pellet dryer includes a vertically disposed housing having a cylindrical screen vertically supported therein with a bladed rotor oriented in the screen for conveying a slurry of water and polymer resin pellets upwardly through the screen to enable centrifugal forces to discharge water outwardly through the screen while the dried pellets are discharged from an upper end of the screen and water is discharged from the lower end of the housing in a well known manner.

The screen is typically constructed of two sections connected together by a support ring or connecting band to support and maintain the adjacent ends of the screen sections in a cylindrical configuration concentric with the rotor to enable effective upward conveyance of the slurry and effective discharge of water through the screen without damage to the screen or the rotor.

In accordance with the present invention, the drawbacks associated with prior art support rings are overcome by incorporating a generally perpendicular, peripheral flange which extends outwardly (in a generally horizontal direction in a vertical type pellet dryer) around a substantial portion of the support ring. The outwardly extending flange serves to reinforce the support ring in the lateral direction to rigidify the ring in its prescribed circular shape when installed on adjacent screen section ends, or any screen end. In view of the rigid construction of the support ring of the present invention, arising from the presence of the horizontal flange, the support ring is made up of a plurality of ring sections forming a prescribed circle, preferably two semicircular sections. The flange is also preferably provided wit the necessary attaching structure for the assembly of the ring sections and for connection to the supporting brackets attached to the dryer housing. As a result, the holes or other weakened areas in conventional support rings or bands can be eliminated, and the hardware for assembling and disassembling the ring is more readily accessible and more quickly used.

In a preferred form of the invention, the support ring includes two semicircular ring sections. Each section has a wider cylindrical inner band which aligns interiorly of the screen section ends and a narrow cylindrical outer band which is disposed between and spaces the adjacent ends of the screen sections. The outwardly extending, peripheral flange is rigidly mounted on one edge of the outer band, preferably the upper edge. The generally horizontal flange (in a vertical type dryer) has connecting structure, preferably a tab, at each end for assembling the ring sections together, such as by a threaded bolt extending through holes in the end tabs. The flange also preferably has attaching holes at spaced locations for connection to adjustable support brackets oriented in peripherally spaced locations on the interior of the housing thereby effectively supporting and maintaining the cylindrical configuration of the screen sections around the assembled support ring.

It is therefore an object of the present invention to provide an improved support and rigidifying ring structure for adjacent ends of screen sections forming an elongated, vertically disposed cylindrical screen in a centrifugal pellet dryer, particularly a vertical type pellet dryer. The ring structure for supporting the adjacent ends of the screen sections rigidly engages the screen section ends to maintain their cylindrical configuration and to maintain concentricity of the screen with respect to the rotational axis of the bladed rotor.

Another object of the invention is to provide an improved support ring for a sectional cylindrical screen in a centrifugal pellet dryer in the form of a multiple piece, rigid annular ring which includes a radially extending flange that encircles the external periphery of a connecting band assembled between adjacent ends of cylindrical screen sections.

A further object of the invention is to provide an improved support ring in accordance with the preceding objects which includes a radially extending, generally perpendicular, peripheral flange on the external surface of the connecting band for rigidifying the band and ring.

Still another object of the invention is to provide an improved support ring for a centrifugal pellet dryer in accordance with the preceding objects in which the radial flange and connecting band are of a two piece construction, and turnbuckle structures connect the flange to brackets on the interior of an outer housing of the pellet dryer.

A still further object of the invention is to provide an improved support ring in accordance with the preceding objects in which the ends of each radial flange include readily accessible and easily used connecting structure for quick and easy assembly and disassembly of the ring in relation to the cylindrical screen sections and housing.

These together with other objects and advantages which will become subsequently apparent reside in the details of construction and operation as more fully hereinafter described and claimed, reference being had to the accompanying drawings forming apart hereof, wherein like numerals refer to like parts throughout.

DESCRIPTION OF THE PREFERRED EMBODIMENT

Figure 1:
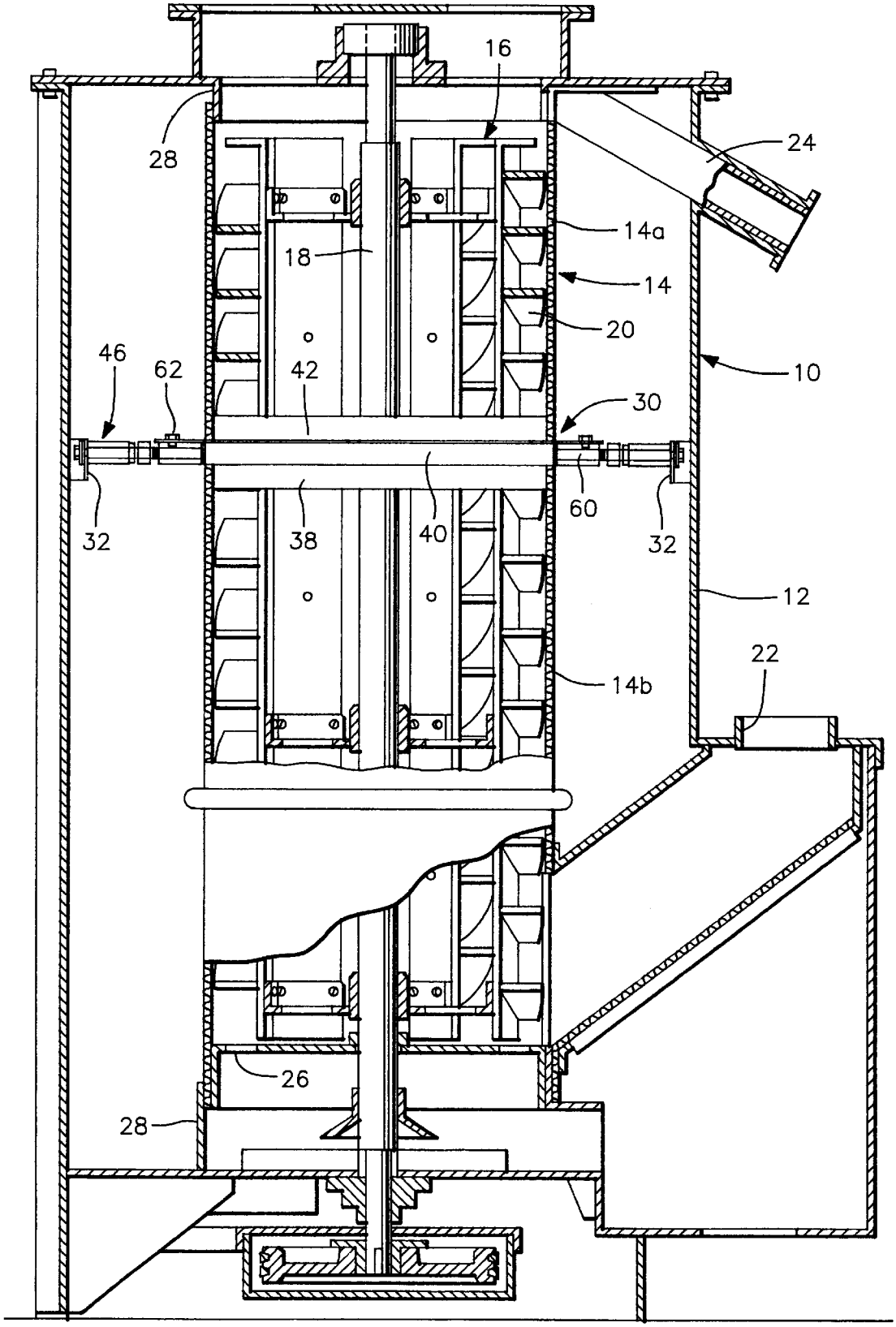
FIG. 1 is a schematic sectional view illustrating the support ring of the present invention incorporated into a conventional centrifugal pellet dryer of the vertical type.
Figure 2:
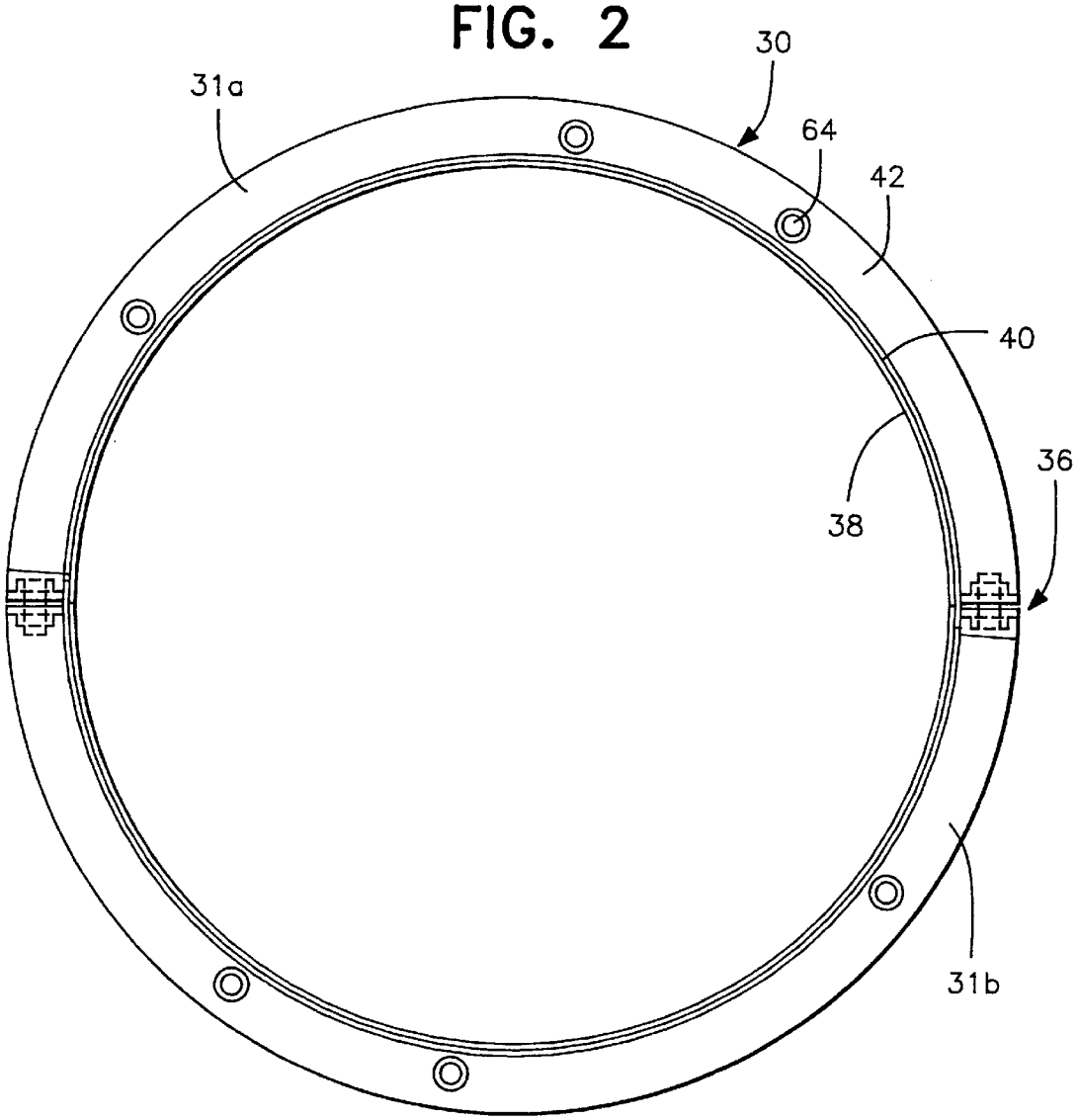
FIG. 2 is a top plan view of the support ring in accordance with the present invention, illustrating the ring in assembled condition.
Figure 3:
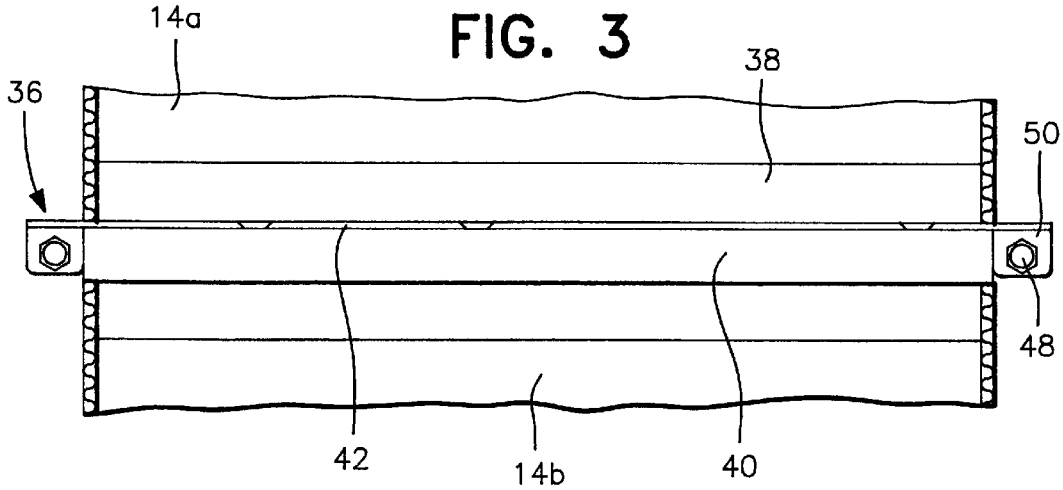
FIG. 3 is a side elevational view of the support ring of the present invention, illustrating its association with upper and lower screen sections when assembled.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Referring to the drawings, FIG. 1 illustrates a conventional centrifugal pellet dryer of the vertical type generally designated by reference numeral 10. Dryer 10 includes a vertical housing 12 in which a vertical cylindrical screen 14 is mounted. The screen 14 encloses and is concentric to a bladed rotor generally designated by reference numeral 16 which includes a central shaft 18 and inclined blades 20 to elevate a slurry of water and polymer resin pellets from an inlet 22 at the bottom of the screen 14 toward an outlet 24 adjacent the upper end portion of the screen. Water is discharged outwardly through the screen 14 by centrifugal force as the water and pellet slurry is lifted by blades 20, and the water collects and is discharged through a water outlet 26 at the bottom of the housing 12. The upper and lower ends of the screen are supported by annular ring-like members 28 or other well known and conventional support structures such as those disclosed in the aforementioned commonly owned prior patents or, possibly, by the support ring of the present invention.

Figure 7:
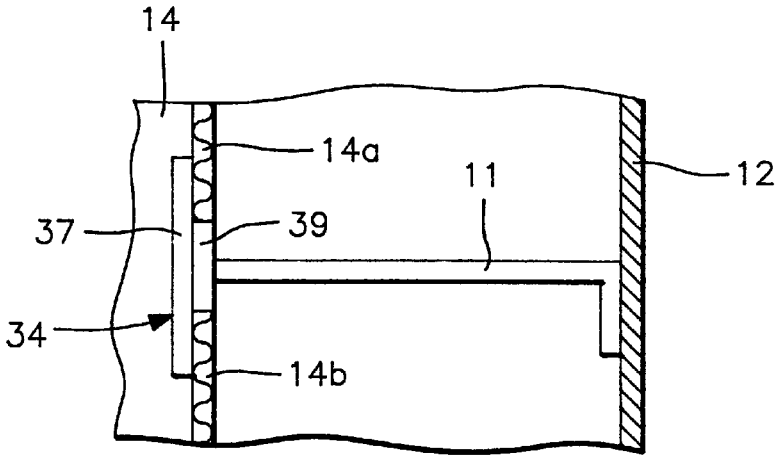
FIG. 7 (PRIOR ART)
FIG. 7 is a schematic sectional view of a prior art, two piece support ring or connecting band used to connect and support adjacent ends of screen sections.

As shown in FIG. 7, in the prior art, the cylindrical screen 14 includes vertically aligned cylindrical sections 14*a* and 14*b* connected together by a connecting band or support ring generally designated by the numeral 34. The prior art support ring 34 includes a wide inner cylindrical band 37 positioned interiorly of the screen sections 14*a* and 14*b*. A narrower outer band 39 is fixedly secured to the outer surface of the inner band 37 around the vertical center of band 37. When assembled, the outer band 39 is positioned between and in abutting engagement with adjacent end edges of screen sections 14*a* and 14*b* which telescope over the top and bottom exterior surfaces of the inner band 37. The inner surface of the inner band 37 is spaced radially outwardly from the path of movement of the outer edges of the bladed rotor 16 so that the blades on the rotor 16 will lift the pellets in the screen 14 in a well known manner. The outer band 39 is positioned in the housing 12 by brackets 11, which are typically attached to the ring 34 by screws or the like which extend through holes in the bands 37 and 39. The brackets retain the adjacent ends of screen sections 14*a* and 14*b* in proper relation to the housing 12 and rotor 16.

The improved support ring of the present invention is illustrated in FIGS. 1–6, and is generally designated by reference numeral 30. The ring 30 includes an inner band 38 and an outer band 40 similar to bands 37 and 39, respectively, of prior art ring 34. Mounted on the exterior of the outer band 40 of the ring 30 along the top edge of the band 40 is a radial flange 42 which extends outwardly in generally perpendicular relation to the bands 38 and 40. The flange 42 rigidities the bands 38 and 40 and maintains their cylindrical configuration. The support ring 30 is supported by a plurality of bracket structures 32 secured to the flange 42 at peripherally spaced points around the interior of the housing 12. Hence, when assembled with screen sections 14*a* and 14*b* and bracket structures 32, the flange 42 of ring 34 serves to ensure the cylindrical configuration of the screen 14 and the concentricity of the screen 14 with respect to the rotor 16 and the rotational axis of the shaft 18.

The specific structure of the support ring 30 is illustrated in FIGS. 2–6. The support ring 30 includes two semicircular ring segments 31*a* and 31*b*, joined at diametrically opposed locations by separable fastener structures generally designated by the numeral 36. The narrow outer band 40 is mounted on the outside of wider inner band 38 by spot welding or the like. The vertical height of the inner band 38 is preferably on the order of about 3 inches and the outer band 40 is preferably about 1 inch in height, thus leaving approximately 1 inch of the inner band 38 extending above and below the top and bottom edges of the outer band 40. Located on the exterior of the inner band 38 and at the upper edge of outer band 40 is the rigidifying flange 42 that is rigidly fixed to the exterior of the inner band 38 generally about 1 inch below the upper edge thereof. The flange 42 is preferably about 2 inches wide and is welded to the exterior of the inner band 38 and along the top edge of outer band 40. Depending on the size of the centrifugal dryer, support rings according to the present invention range in diameter from about 8.34 inches to about 62.12 inches. As many as five or six support rings may be used on the larger dryers to interconnect, support and rigidify the screen sections.

Figure 4:
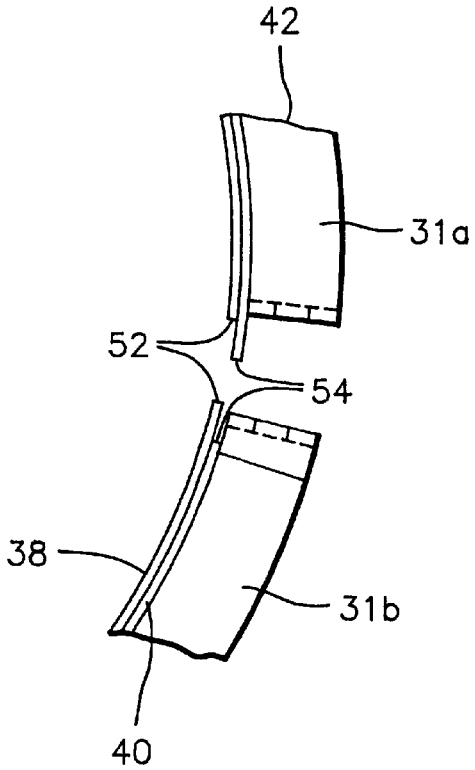
FIG. 4 is a detailed plan view of two adjacent ends of the support ring of the present invention prior to assembly.
Figure 5:
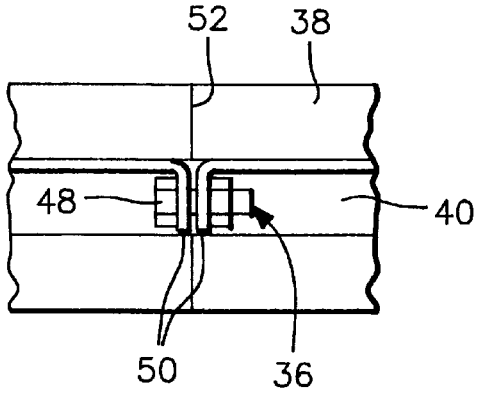
FIG. 5 is a fragmental elevational view illustrating the manner in which the end tabs on the radial flange of the support ring of the present invention are interconnected by a separable fastening bolt.
Figure 6:
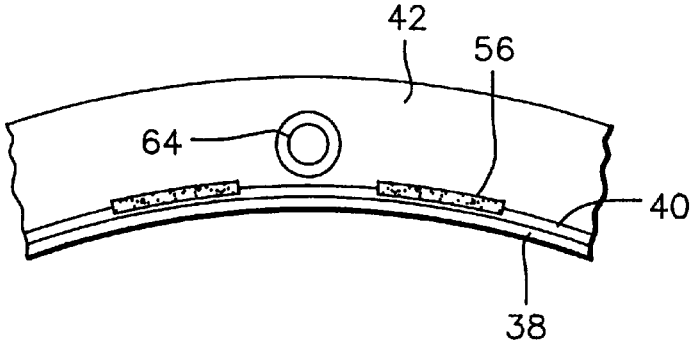
FIG. 6 is a further detailed plan view of a segment of the support ring illustrating the welded connection between the flange and the connecting band member.

The fastener structure 36 includes a fastener bolt 48 which extends through depending flange ends or tabs 50 at the opposite ends of the semicircular flanges 42 as illustrated best in FIG. 5. The end tabs 50 are formed by bending end portions of the flanges 42 downwardly and are provided with apertures for receiving the bolt 48. The end tabs 50 are preferably spaced apart slightly to enable assembly and rigidified connection between the semicircular segments of the bands 38 and 40 of support ring 30. As illustrated in FIG. 4, the inner band 38 has terminal ends 52 which are generally aligned with the space between the end tabs 50. The outer band 40 includes terminal ends 54 which are staggered in relation to the ends 52 so that a telescopic over-lapping joint is provided between the inner band 38 and outer band 40. As illustrated in FIG. 6, each of the flanges 42 is welded to the narrow outer band 40 at spaced areas 56 thereby forming a rigid assembly of the flange 42 and outer band 40.

The support ring 30 of this invention can be easily assembled onto the screen sections by positioning the semicircular segments of the inner band 40 against the interior of the adjacent ends of screen sections 14*a* and 14*b* with the outer band 40 positioned between the ends of the screen sections. The flanges 42 are extending outwardly. The end tabs 50 can then be easily connected by the fastening bolts 48. This rigidities the central portion of the screen and maintains its cylindrical configuration and also maintains its concentricity with rotor blades 20 and the rotational axis of the rotor 16. By maintaining the desired cylindrical configuration, wear on the screen sections and the rotor blades is reduced, thus resulting in a longer life expectancy for these components. The flanges 42 are then connected to the brackets 32 on the housing 12 by turnbuckle connectors 46 thus providing support for the support ring 30 and the adjacent ends of the screen sections 14*a* and 14*b*.

The turnbuckle connectors 46 each include an internally threaded sleeve 60 attached in underlying relation to flange 42 by bolts 62 extending through holes 64 in flange 42. The outer end of the turnbuckle connector is connected to bracket 32 so that the position of the support ring 30 can be accurately adjusted for optimum position of the adjacent ends of the screen sections 14*a* and 14*b*. The number and position of the turnbuckle connectors and brackets may vary depending upon the size of the screen and position of doors in the housing. This structure provides an easily assembled and effective structure for supporting and maintaining the cylindrical configuration of the screen in various types of pellet dryers.

While a two piece semicircular construction for the support ring of this invention is preferred, it is possible that more than two ring segments, such as three or four ring segments, could be assembled. Further, while a two piece connecting band, such as inner and outer bands 38 and 40, is preferred, a single cylindrical band or segment could be used with the flange 42 attached around the periphery. Also, other known attaching mechanisms could be utilized instead of tab ends 50 and/or fastening bolts 48. Moreover, some of the ring segments could be permanently attached as by pivoting mechanisms or the like.

In addition, the flange 42 need not extend around substantially all of the support ring 30, although this is preferred. The flange 42 also need not be perpendicular to bands 38 and 40, but should be at such sufficient angle and extend around to such substantial extent as to provide the rigidity to the connecting band, such as bands 38 and 40, necessary to maintain the prescribed cylindrical configuration to adjacent ends of screen sections 14*a* and 14*b*.

The foregoing is considered as illustrative only of the principles of the invention. Further, since numerous other modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A screen support for a cylindrical dryer screen in which the dryer includes a housing enclosing said screen, said screen support comprising a plurality of arcuate, substantially rigid members separably connected at end portions thereof and engaging, rigidifying and supporting said screen, at least one of said arcuate members including a radially outwardly extending flange in supporting association with said housing to support said arcuate members and said screen.

2. The screen support as defined in claim 1, wherein each of said arcuate members includes an arcuate connecting band engaged with adjacent ends of said screen sections, said flange being perpendicular to said connecting band and rigidly affixed thereto and radial support members on said flange in supporting engagement with said housing.

3. The screen support as defined in claim 2, wherein said flange extends substantially throughout the entire length of said connecting band.

4. The screen support as defined in claim 3, wherein said flange includes end tabs in perpendicular relation to said flange and in perpendicular relation to said connecting band and separable fastening structures interconnecting said end flanges to separably connect adjacent ends of said connecting band and flanges.

5. The screen support as defined in claim 1, wherein each of said arcuate members are semicircular in configuration for engagement with said cylindrical screen for maintaining the cylindrical configuration of said screen and supporting the screen in concentric relation to a rotatable bladed rotor within the screen.

6. The screen support as defined in claim 5, wherein each arcuate connecting band includes concentric inner and outer bands of unequal width with the narrower band being disposed between adjacent ends of aligned screen sections comprising said screen.

7. The screen support as defined in claim 1, wherein each arcuate connecting band includes an inner band of cylindrical configuration for engagement with the interior of adjacent ends of aligned screen sections comprising said screen, an outer band on the exterior of said inner band and having a vertical height substantially less than the inner band, said flange extending rigidly outwardly from an upper edge of said outer band for rigidifying the connecting band and adjacent ends of said screen sections.

8. The screen support as defined in claim 7, wherein each of said arcuate connecting bands and flanges are semicircular in configuration.

9. The screen support as defined in claim 8, wherein said flange includes bolt openings for detachable support from brackets on an interior of said housing.

10. The screen support as defined in claim 9, wherein each end of each flange is provided with an end flange perpendicular to the flange and perpendicular to said arcuate band, a separable fastener interconnecting said end flanges for assembling the semicircular arcuate connecting bands and flanges in circular configuration.

11. The screen support as defined in claim 10, wherein said arcuate inner and outer bands have end edges oriented in staggered over-lapping relation.

12. In combination, an upper cylindrical screen, a lower cylindrical screen, and a support ring between adjacent ends of said screens to maintain the screens in alignment and the adjacent ends in cylindrical configuration, said support ring including a connecting band and a radial outwardly extending rigid flange mounted to the connecting band for rigidifying said connecting band and adjacent ends of said screens.

13. The combination as defined in claim 12 wherein said connecting band includes inner and outer cylindrical bands rigidly interconnected with the inner band being wider than the outer band, said inner band engaging the interior of adjacent ends of said screens, said outer band being positioned between the adjacent ends of said screens, said flange extending outwardly from said outer band.

14. The combination as defined in claim 12 wherein said connecting band and flange are in the form of two semicircular components having separably fastened ends to enable assembly in relation to the screens.

15. A dryer including a cylindrical screen, a bladed rotor rotatably positioned within said screen and a support structure for said screen, said screen including a pair of cylindrical screen sections in aligned relation, said screen sections including adjacent ends, and connecting and supporting structure engaging and supporting said adjacent ends to maintain the cylindrical configuration of the screen sections and to maintain the screen in concentric relation to said rotor, said connecting and supporting structure for said adjacent ends of the screen sections comprising a substantially rigid cylindrical band engaged telescopically with said adjacent ends of said screen sections and a flange rigidly affixed to said band substantially around its circumference and extending radially outwardly and generally perpendicular in relation thereto thereby rigidifying said band to maintain the cylindrical configuration of the band and adjacent ends of said screen sections, and support members connected between said flange and said screen support structure.

16. The dryer as defined in claim 15 wherein said band is engaged with the interior surface of each of said adjacent ends of said screen sections.

17. The dryer as defined in claim 16 wherein said band and flange are semi-circular in configuration and provided with separably connected ends to enable easy assembly of said connecting and supporting structure with said screen sections.

18. The dryer as defined in claim 17 wherein said band includes a wider inner band and a narrow outer band rigidly affixed to the outer surface of said inner band, said narrow band being positioned between end edges of said adjacent ends of said screen sections, said flange being rigidly mounted on said narrow outer band to maintain the cylindrical configuration of the connecting and supporting band.

19. The dryer as defined in claim 18 wherein said screen, rotor and support structure is vertically disposed, said support structure including a housing enclosing said screen, said housing and screen including an inlet for a slurry of water and polymer resin pellets and an outlet of dried pellets, said housing including a water discharge at a bottom portion thereof, said support members being connected between said flange and housing and being adjustable to accurately position the connecting and supporting structure and the adjacent ends of the screen sections in relation to said rotor to reduce wear on the screen and blades on the bladed rotor.

* * * * *